US005200308A

United States Patent [19]

Ohtani et al.

[11] Patent Number: 5,200,308

[45] Date of Patent: Apr. 6, 1993

[54] COLOR PHOTOGRAPHIC MATERIAL

[75] Inventors: Hirofumi Ohtani; Hiroshi Shimazaki; Yoshitaka Yamada, all of Hino, Japan

[73] Assignee: Konica Corporation, Tokyo, Japan

[21] Appl. No.: 636,419

[22] Filed: Dec. 31, 1990

[30] Foreign Application Priority Data

Jan. 19, 1990 [JP] Japan ..... 2-10972

[51] Int. Cl.[5] ..... G03C 1/08

[52] U.S. Cl. ..... 430/508; 430/504; 430/505; 430/574; 430/607; 430/611; 430/603; 430/604

[58] Field of Search ..... 430/504, 505, 574, 508

[56] References Cited

U.S. PATENT DOCUMENTS 2,597,856 5/1952 Damschroder ..... 430/603
4,028,115 6/1977 Hinata et al. ..... 430/574
4,837,140 6/1989 Ikeda et al. ..... 430/574
5,024,925 6/1991 Deguchi ..... 430/505
5,037,728 8/1991 Shiba et al. ..... 430/504
5,053,324 10/1991 Sasaki ..... 430/504

FOREIGN PATENT DOCUMENTS 160449 7/1987 Japan .

*Primary Examiner*—Charles L. Bowers, Jr.
*Assistant Examiner*—Thomas R. Neville
*Attorney, Agent, or Firm*—Jordan B. Bierman

[57] ABSTRACT

The improved color photographic material has on a support at least one blue-sensitive silver halide emulsion layer, at least one green-sensitive silver halide emulsion layer and at least one red-sensitive silver halide emulsion layer, each of those emulsion layers having a specified spectral response. This color photographic material has high chroma and insures faithful reproduction of color hues even under illumination with a fluorescent lamp.

5 Claims, No Drawings

COLOR PHOTOGRAPHIC MATERIAL

BACKGROUND OF THE INVENTION

This invention relates to a color photographic material, more particularly to a color photographic material that has high chroma and that insures faithful reproduction of color hues even under illumination with a fluorescent lamp.

The recent advances in the photographic industry have been remarkable as regards the improvement in the quality of image of multi-layered silver halide color photographic materials. Three major elements of image quality are granularity, sharpness and fidelity of color reproduction and the levels of these factors have been markedly enhanced in modern photographic materials. It is generally held that prints and slides available today are usually more or less satisfactory to users.

As for the fidelity of color reproduction, substantial improvements have been achieved in color purity but the colors that have been considered to be unsuitable for reproduction by photography still remain in the same situation. In short, reproduction of color hues is still unsatisfactory in many respects. For example, purple and bluish purple that reflect light longer than 600 nm, or colors of green shades such as bluish green and yellow green are reproduced in an entirely different way than the original, often disappointing users.

Two major factors that relate to color reproduction are the spectral response and the interimage effect. As for the interimage effect, it is known in the art of multi-layered silver halide color photographic materials to add compounds that couple with the oxidation product of color developing agents to form development restrainers or precursors thereof. The development restrainers released from those "DIR compounds" inhibit development from occurring in other color-forming layers, thereby creating the interimage effect and hence achieving improved color reproduction. In color negative films, an effect similar to the interimage effect can be attained by using colored couplers in greater amounts than are necessary to cancel unwanted absorption. However, if colored couplers are used in excess amounts, the minimum density of the films will increase to cause considerable difficulty in determining the amount by which color density should be corrected in printing operation, and this often results in the deterioration of the quality of colors in the finished print. The techniques described above are mostly dedicated to improving color purity, rather than color hues, in color reproduction.

"Diffusible DIR" compounds which permit a greater mobility of restraining groups or precursors thereof are commonly used today and they have made great contribution to improvements in color purity. However, the interimage effect involves great difficulty in controlling its directionality and the use of such DIR compounds can alter color hues although they are effective in increasing color purity. For techniques of controlling the directionality of the interimage effect, see U.S. Pat. No. 4,725,529 and other references.

As for the spectral response which is the other major factor of color reproduction, U.S. Pat. No. 3,672,898 describes spectral responses that are appropriate for reducing the variations in color reproduction that occur on account of the use of different light sources in taking pictures. However, this technique is not effective for the purpose of correction the above-mentioned colors which are inherently low in the fidelity of color reproduction. A technique has also been proposed for combining spectral responses with the interimage effect. According to JP-A-61-34541 (the term "JP-A" as used herein means an "unexamined published Japanese patent application") and other references, this approach was used, with some success, to correct colors that are inherently low in the fidelity of color reproduction on color negative films. A typical example of this method consists of combining the inherent effects of conventional blue-, green- and red-sensitive layers with the interimage effect other than at the dominant wavelengths of the respective layers.

This technique, if performed successfully, is effective in improving to some extent the reproduction of certain colors but, in practice, in order for the interimage effect to be exhibited, not only the basic blue-, green- and red-sensitive layers but also a separate layer for exhibiting the interimage effect as well as other kinds of light-sensitive silver halides are necessary and this has increased the production cost due to the increase in the amount of silver and in the number of production steps. Further, the interimage effect achieved has been for from being satisfactory.

U.S. Pat. No. 3,672,898, supra teaches spectral responses that are appropriate for reducing the variations in color reproduction caused by the use of different light sources in taking pictures. The heart of this technique is to bring the spectral responses of blue- and red-sensitive layers close enough to that of a green-sensitive layer to reduce the variations in the sensitivity of each layer in response to the change in light source, especially in its color temperature, thereby minimizing the possible changes in color. A problem with this approach is that the spectral responses of the three light-sensitive are brought so close to one another that the resulting overlaps in the spectral sensitivity curves will lower the purity of colors. As is well known, this problem can be partly solved by emphasizing the interimage effect through the use of "diffusible DIR" compounds. However, even this improvement turned out to be very unsatisfactory in the fidelity of color reproduction when the light source was a fluorescent lamp as in the most common current practice of taking pictures indoors.

SUMMARY OF THE INVENTION

The present invention has been made under these circumstances and has as an object providing a high-speed silver halide color photographic material that is capable of faithful reproduction of colors of bluish purple and green shades and that will produce a color image having none of the undesired green shades even if pictures are taken under a fluorescent lamp.

As a result of the intensive studies they conducted, the present inventors found that the above-stated object of the invention could be attained by a color photographic material having on a support at least one blue-sensitive silver halide emulsion layer containing a yellow forming color coupler, at least one-green-sensitive silver halide emulsion layer containing a magenta forming color coupler, and at least one red-sensitive silver halide emulsion layer containing a cyan forming color coupler, in which photographic material the spectral response of said blue-sensitive silver halide emulsion layer, $S_B(\lambda)$, satisfies the following conditions:

(A) 410 nm$\leqq\lambda_B^{max}\leqq$480 nm where $\lambda_B^{max}$ is the wavelength at which $S_B(\lambda)$ is maximum; and (B) 470 nm$\leqq\lambda_B^{80}\leqq$490 nm where $\lambda_B^{80}$ is the wavelength at which $S_B(\lambda)$ is 80% of $S_B(\lambda_B^{max})$;

the spectral response of said green-sensitive silver halide emulsion layer, $S_G(\lambda)$, satisfies the following conditions:

(A) 530 nm$\leqq\lambda_G^{max}\leqq$590 nm where $\lambda_G^{max}$ is the wavelength at which $S_G(\lambda)$ is maximum; and (B) 520 nm$\leqq\lambda_G^{80}\leqq$550 nm and 550 nm$\leqq\lambda_G^{80}\leqq$600 nm where $\lambda_G^{80}$ is the wavelength at which $S_G(\lambda)$ is 80% of $S_G(\lambda_G^{max})$;

the spectral response of said red-sensitive silver halide emulsion layer, $S_R(\lambda)$, satisfies the following conditions:

(A) 600 nm$\leqq\lambda_R^{max}\leqq$640 nm where $\lambda_R^{max}$ is the wavelength at which $S_R(\lambda)$ is maximum; and (B) 580 nm$\leqq\lambda_R^{50}\leqq$600 nm and 645 nm$\leqq\lambda_R^{50}\leqq$659 nm where $\lambda_R^{50}$ is the wavelength at which $S_R(\lambda)$ is 50% of $S_R(\lambda_R^{max})$, with $S_R(\lambda_R^{610})$, or the sensitivity at 610 nm, being at least 85% of $S_R(\lambda_R^{max})$, or the sensitivity at the wavelength of maximum sensitivity.

If the conditions stated above are satisfied, a high-speed color photographic material can be obtained that is capable of faithful reproduction of colors of bluish purple and green shades and that will produce a color image having none of the undesired green shades even if pictures are taken under a fluorescent lamp.

DETAILED DESCRIPTION OF THE INVENTION

The techniques so far proposed for improving the fidelity of reproduction of color hues, particularly in photographing under a fluorescent lamp, are limited and it often occurs that pictures taken under light from a fluorescent lamp have green shades to deprive the human face of animation or liveliness. This is because the light from a fluorescent lamp contains several spectrum lines with the green spectrum line being the most intense and the red spectrum line being positioned in the shorter wavelength region, as a result of which the light which appears white to the human eye is sensed by color films as more greenish but less reddish light. It is therefore necessary for color films playing the same role as the human eye to have such a spectral response that they are less sensitive to the green spectrum line but more sensitive to the red spectrum line. To this end, the spectral responses of a photographic material must be strictly controlled so that bright colors of less green shades, particularly, a vivid and clear flesh color, can be reproduced not only under sunlight, stroboscopic light and a fluorescent lamp but also under mixed lighting using a fluorescent lamp and an electronic flash. Stated more specifically, the object of the present invention can be attained if the spectral responses at an optical density of 1.0 satisfy the conditions set forth hereinabove.

In order to insure satisfactory color reproduction not only under a fluorescent lamp emitting white light but also under a fluorescent lamp emitting three-wavelength light having a red spectrum line at 610 nm, the spectral response of the red-sensitive emulsion layer is particularly important. To achieve the objects of the present invention, $\lambda_R^{max}$ or the wavelength at which a maximum sensitivity is attained, and $\lambda_R^{50}$ or the wavelength at which $S_R(\lambda)$ is 50% of $S_R(\lambda_R^{max})$ must first satisfy the conditions (A) and (B); further, the sensitivity at 610 nm, or $S_R(\lambda_R^{610})$ must be at least 85% of $S_R(\lambda_R^{max})$, with 90% and above being preferred.

The spectral responses necessary to attain the objects of the present invention can be created by combining at least one spectral sensitizer of the general formula (I) shown below with at least one spectral sensitizer of the general formula (III) also shown below. Preferably, at least one spectral sensitizer of the general formula (I), at least one spectral sensitizer of the general formula (II) shown below and at least one spectral sensitizer of the general formula (III) are used in combination. Surprisingly enough, if those spectral sensitizers are used in combination, new aggregates of dye molecules are formed at wavelengths near 610 nm, thereby contributing to a higher value of $S_R\lambda_R^{610}$), i.e., a higher sensitivity at 610 nm.

The amounts in which the spectral sensitizers (I), (II) and (III) are used will vary with the type of emulsion used but preferably they are used in a total amount ranging from $1.0\times10^{-6}$ to $1.0\times10^{-2}$ mol/mol AgX, with the range of $1.0\times10^{-5}$ to $1.0\times10^{-3}$ mol/mol AgX being particularly preferred. As for the relative proportions of the three spectral sensitizers, the amount of the spectral sensitizer (I) is preferably in the range of 20–90%, more preferably 30–80%, of the total amount; the amount of the spectral sensitizer (II) is preferably in the range of 5–50%, more preferably 5–40%, of the total amount; and the amount of the spectral sensitizer (III) is preferably in the range of 5–50%, more preferably 5–40%, of the total amount. The spectral sensitizers may be added either prior to or after the addition of sensitizers but, preferably, the spectral sensitizers are added after the addition of sensitizers in order to restrict the sites of the formation of sensitivity specks.

Supersensitizers may be used in addition to the spectral sensitizers represented by the general formulas (I), (II) and (III). Exemplary supersensitizers include the benzothiazoles and quinolones described in JP-B-57-24533 (the term "JP-B" as used herein means an "examined Japanese patent publication") and the quinoline derivatives described in JP-B-57-24899 and these can be used as required.

The general formulas (I), (II) and (III) are used below in detail:

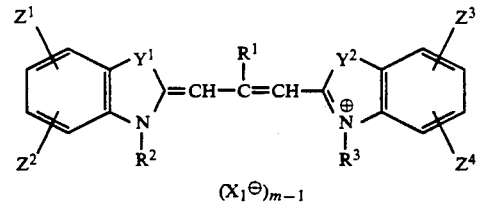

(I)

where $R^1$ is a hydrogen atom, an alkyl group or an aryl group; $R^2$ and $R^3$ are each an alkyl group; $Y^1$ and $Y^2$ are each a sulfur atom or a selenium atom; $Z^1$, $Z^2$, $Z^3$ and $Z^4$ are each a hydrogen atom, a halogen atom, a hydroxyl group, an alkoxy group, an amino group, an acyl group, an acylamino group, an acyloxy group, an aryloxy group, an alkoxycarbonyl group, an aryloxycarbonylgroup, an alkoxycarbonylamino group, a sulfonyl group, a carbamoyl group, an aryl group, an alkyl group or a cyano group; $Z^1$ and $Z^2$ and/or $Z^3$ and $Z^4$ may combine together to form a ring; $X_1\ominus$ is an anion; m is an integer of 1 or 2, provided that m is 1 when the spectral sensitizer of (I) forms an intramolecular salt;

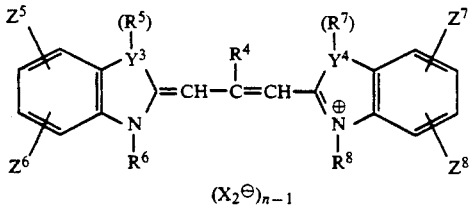

(II)

where $R^4$ is a hydrogen atom, an alkyl group or an aryl group; $R^5$, $R^6$, $R^7$ and $R^8$ are each an alkyl group; $Y^3$ and $Y^4$ are each a nitrogen atom, an oxygen atom, a sulfur atom or a selenium atom, provided that when $Y^3$ is a sulfur atom, an oxygen atom or a selenium atom, $R^5$ is absent and also provided that $Y^3$ and $Y_4$ are not a nitrogen atom at the same time; $Z^5$, $Z^6$, $Z^7$ and $Z^8$ are each a hydrogen atom, a halogen atom, a hydroxyl atom, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, provided that $Z^5$ and $Z^6$ and/or $Z^7$ and $Z^8$ may combine together to form a ring; $X_2\ominus$ is an anion; and n is an integer of 1 or 2, provided that n is 1 when the spectral sensitizer of (II) forms an intramolecular salt;

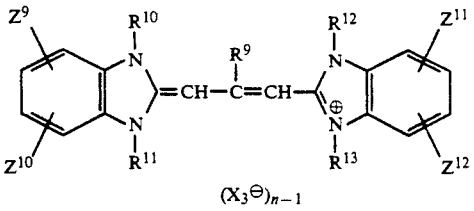

(III)

where $R^9$ is a hydrogen atom, an alkyl group or an aryl group; $R^{10}$, $R^{11}$, $R^{12}$ and $R^{13}$ are each an alkyl group; $Z^9$, $Z^{10}$, $Z^{11}$ and $Z^{12}$ are each a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, provided that $Z^9$ and $Z^{10}$ and/or $Z^{11}$ and $Z^{12}$ may combine to form a ring; $X_3\ominus$ is an anion; and n is an integer of 1 or 2 provided that n is 1 when the spectral sensitizer of (III) forms an intramolecular salt.

Specific but non-limiting examples of the spectral sensitizers represented by the general formulas (I), (II) and (III) are listed below.

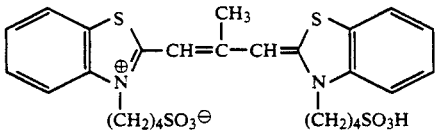

(I-1)

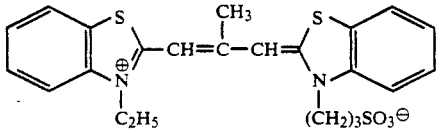

(I-2)

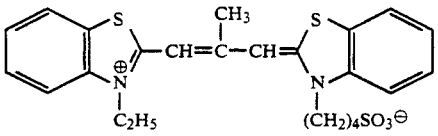

(I-3)

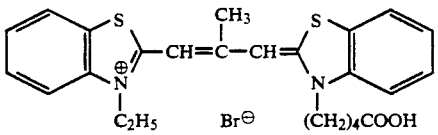

(I-4)

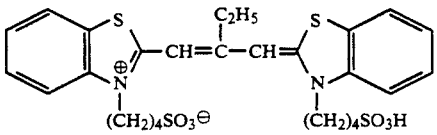

(I-5)

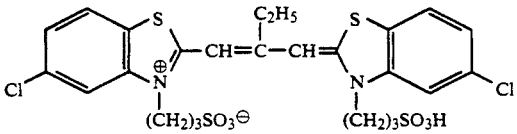

(I-6)

-continued
(I-7)
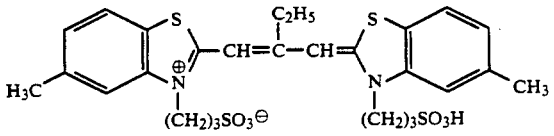
(I-8)
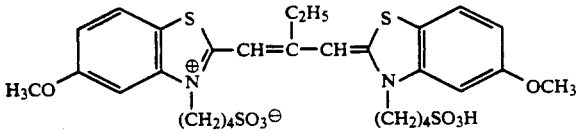
(I-9)
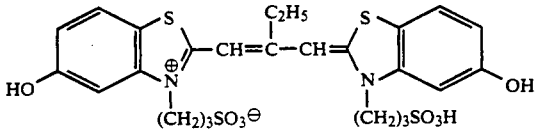
(I-10)
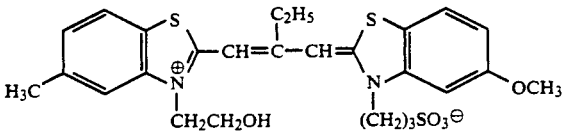
(I-11)
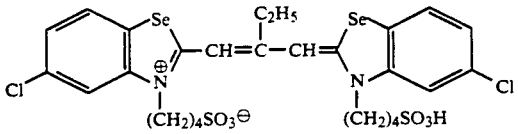
(I-12)
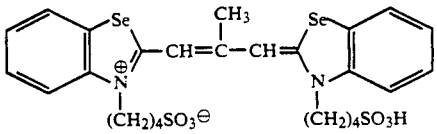
(I-13)
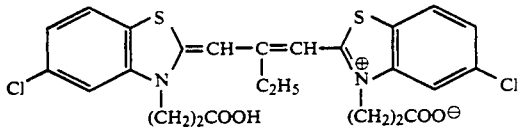
(I-14)
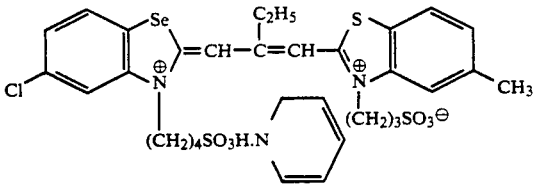
(I-15)
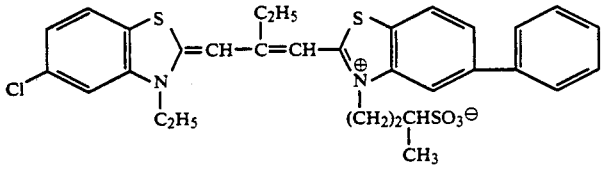
(I-16)
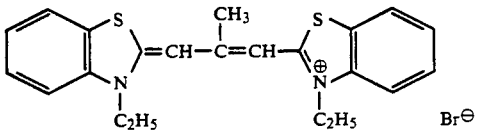

-continued
(I-17)
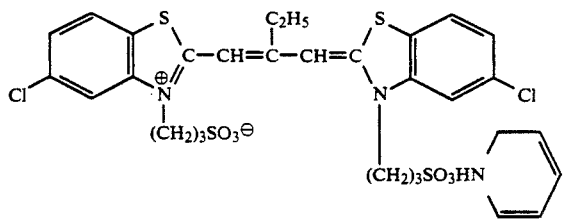
(I-18)
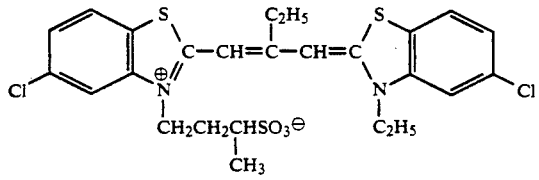
(I-19)
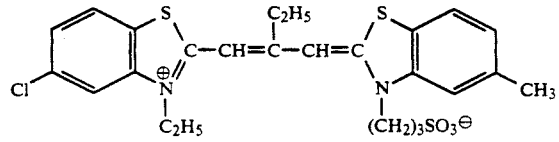
(I-20)
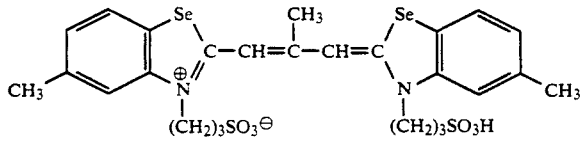
(I-21)
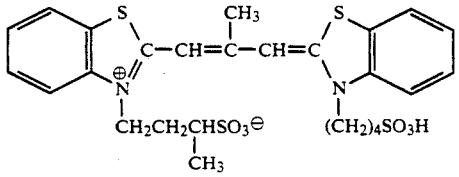
(I-22)
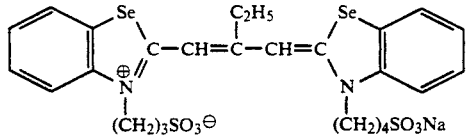
(I-23)
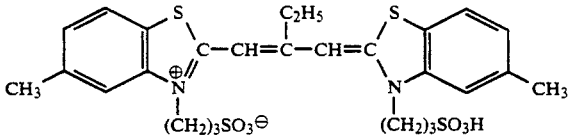
(I-24)
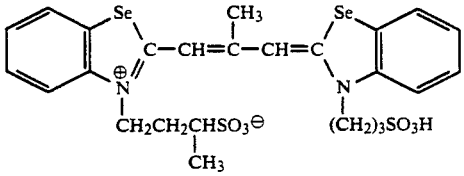
(I-25)
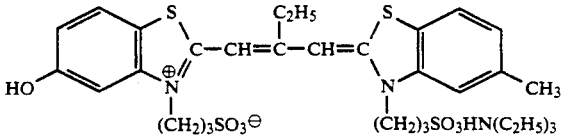

-continued
(I-26)
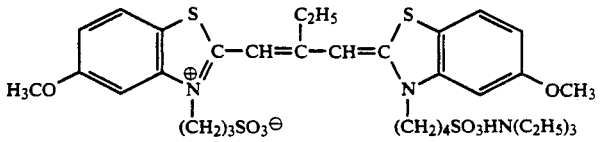
(I-27)
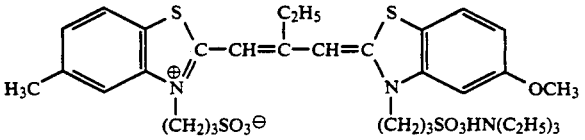
(I-28)
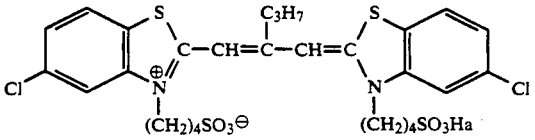
(I-29)
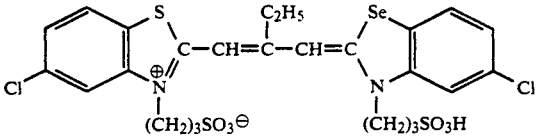
(I-30)
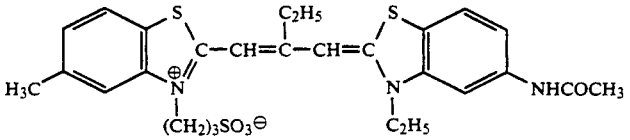
(I-31)
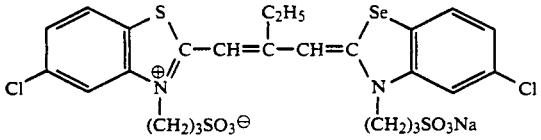
(I-32)
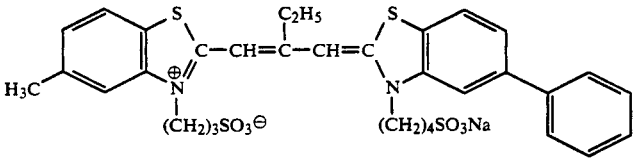
(I-33)
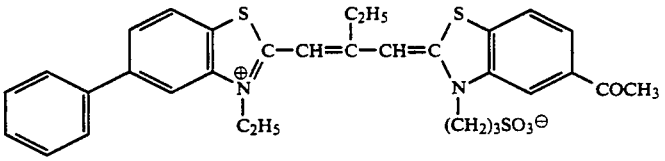
(I-34)
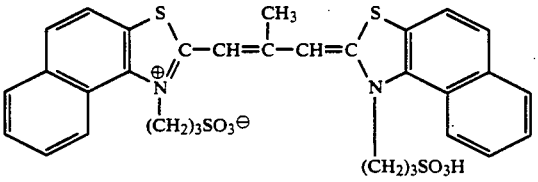

-continued
(I-35)
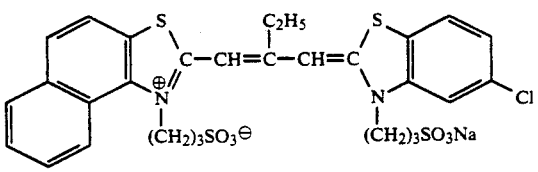
(I-36)
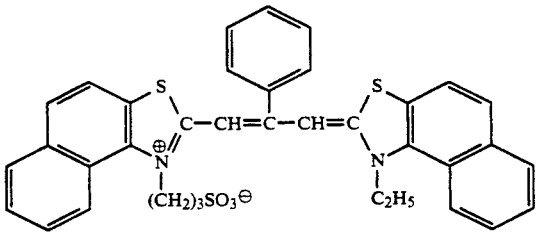
(I-37)
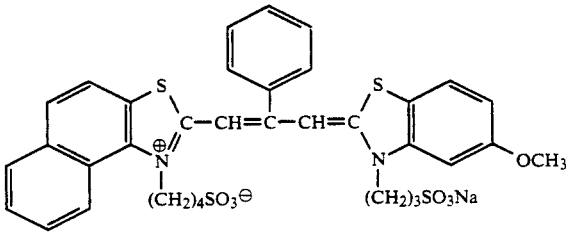
(I-38)
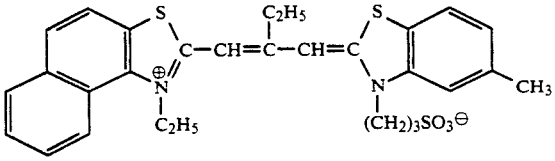
(I-39)
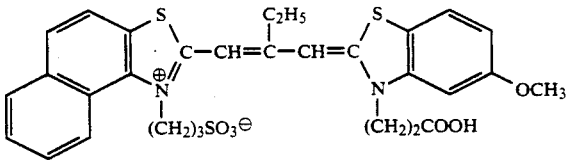
(I-40)
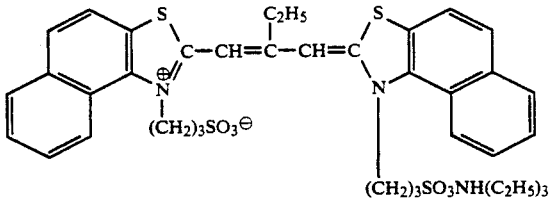
(I-41)
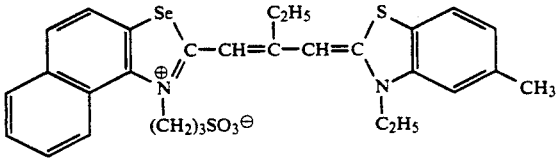

-continued
(I-42)
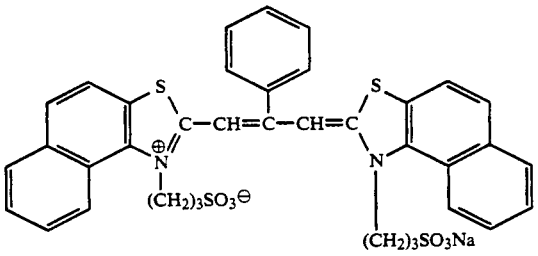
(I-43)
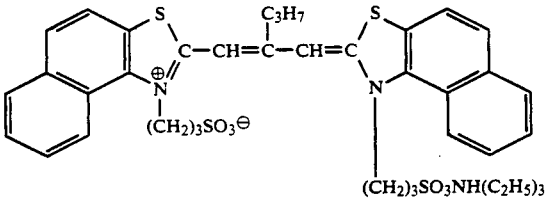
(I-44)
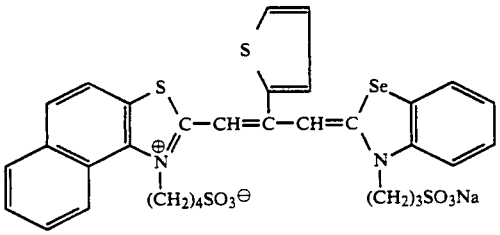
(I-45)
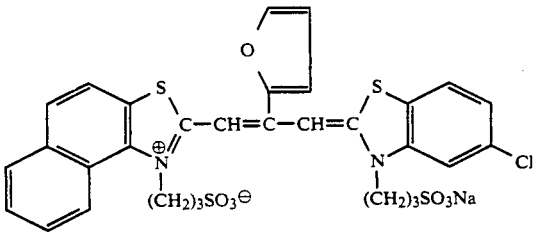
(I-46)
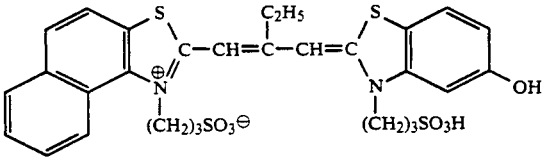
(II-1)
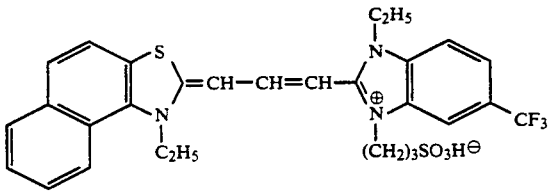
(II-2)
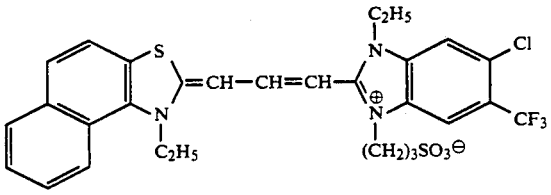

-continued
(II-3)
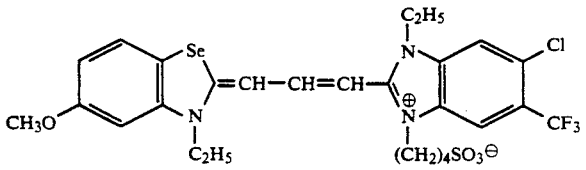
(II-4)
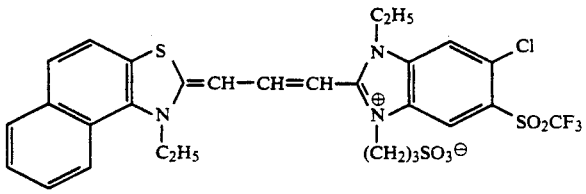
(II-5)
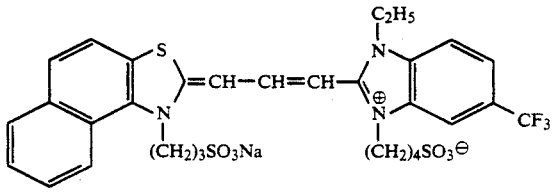
(II-6)
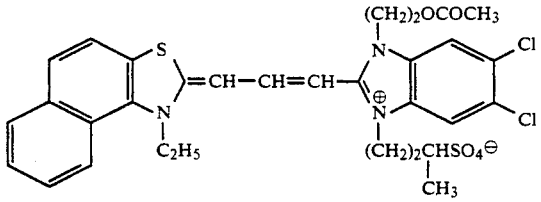
(II-7)
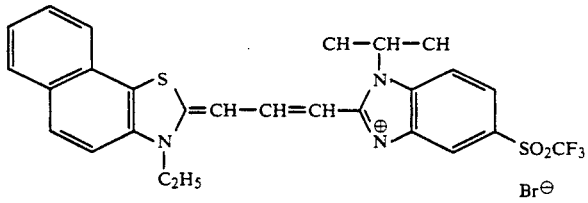
(II-8)
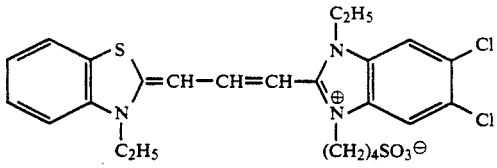
(II-9)
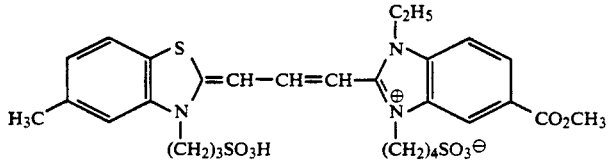
(II-10)
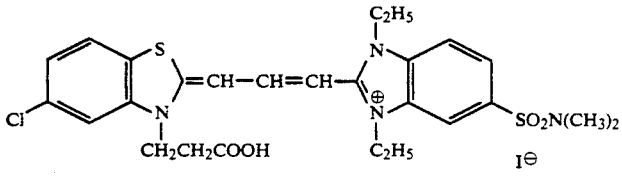

-continued
(II-11)
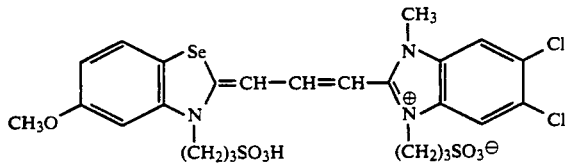
(II-12)
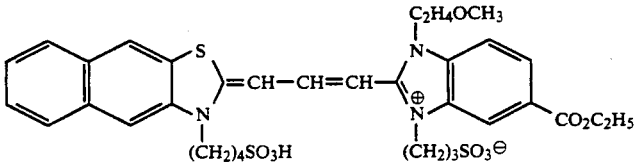
(II-13)
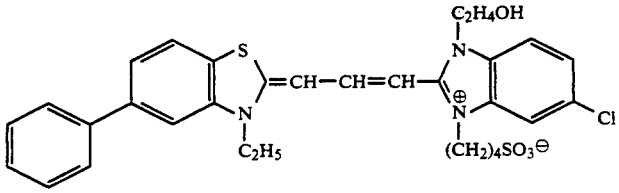
(II-14)
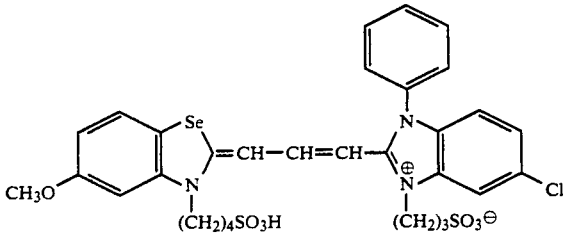
(II-15)
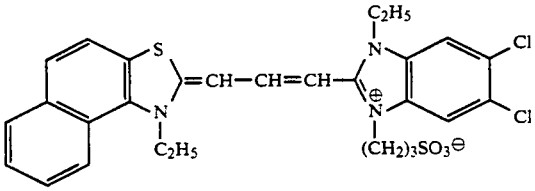
(II-16)
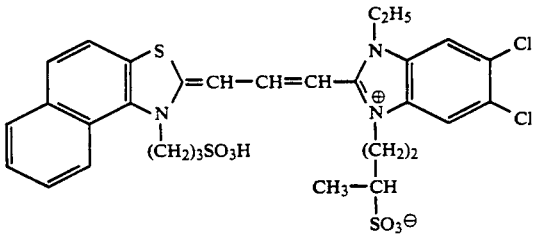
(II-17)
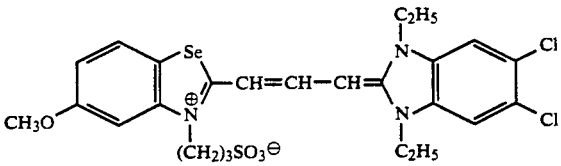
(II-18)
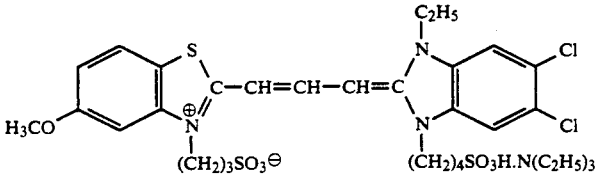

-continued
(II-19)
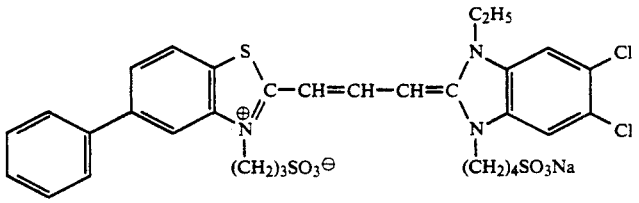
(II-20)
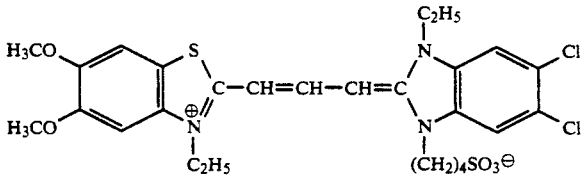
(II-21)
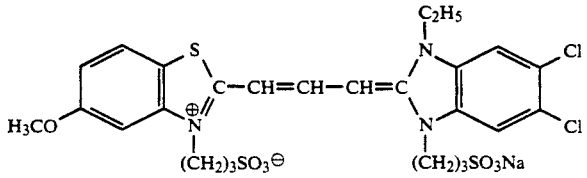
(II-22)
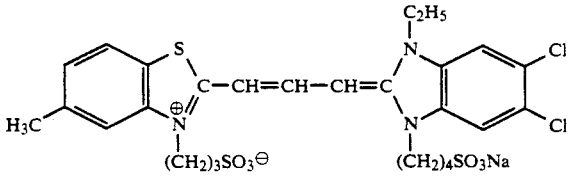
(II-23)
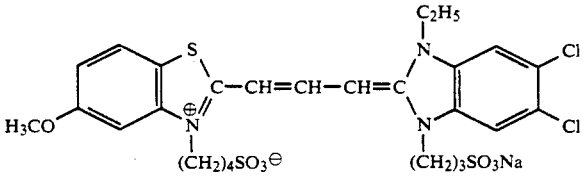
(II-24)
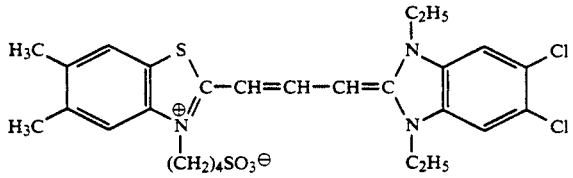
(II-25)
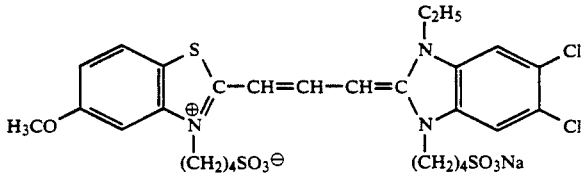
(II-26)
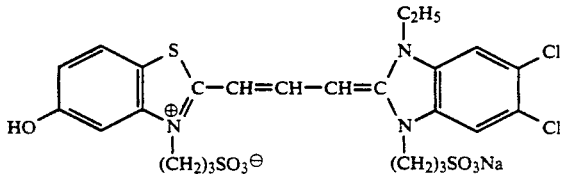

-continued
(II-27)
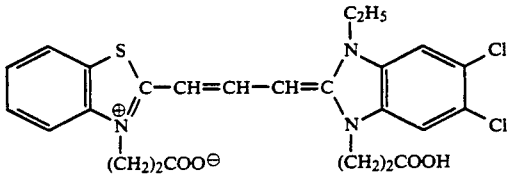
(II-28)
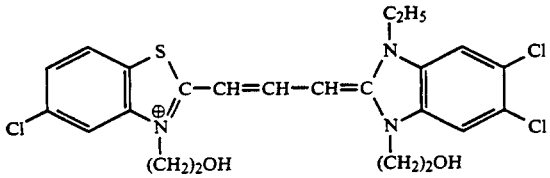
(II-29)
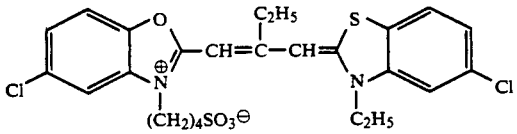
(II-30)
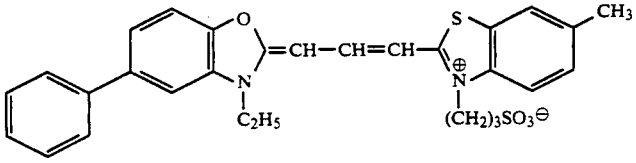
(II-31)
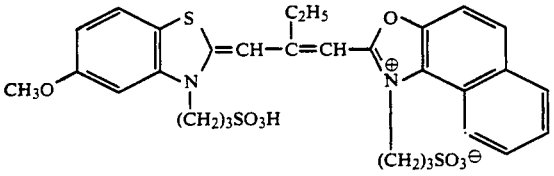
(II-32)
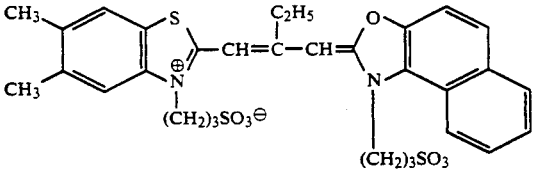
(II-33)
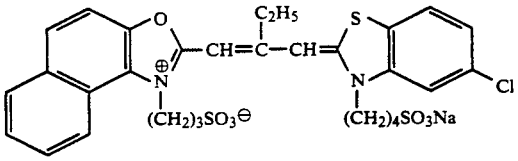
(II-34)
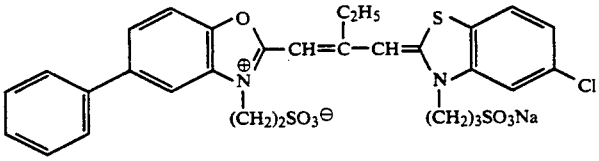
(II-35)
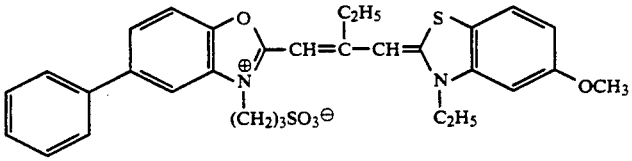

-continued
(II-36)
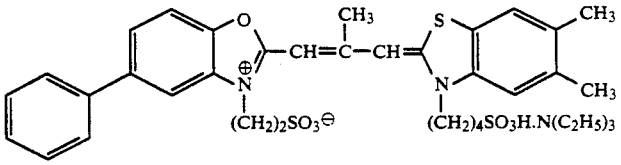
(II-37)
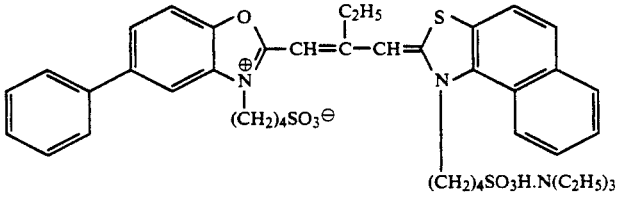
(II-38)
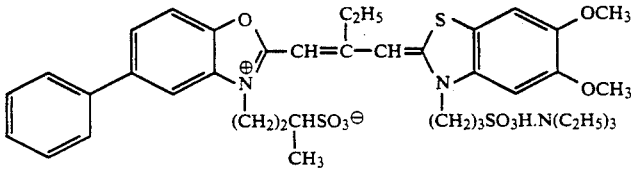
(II-39)
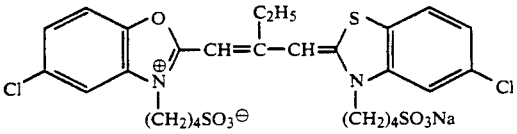
(II-40)
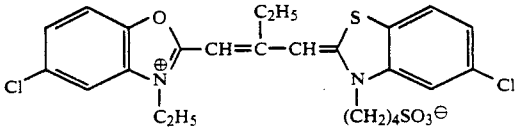
(III-1)
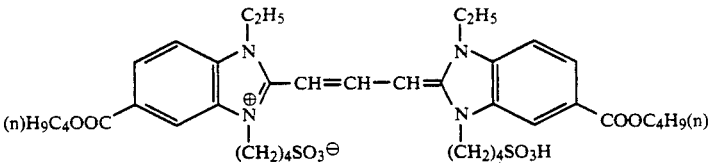
(III-2)
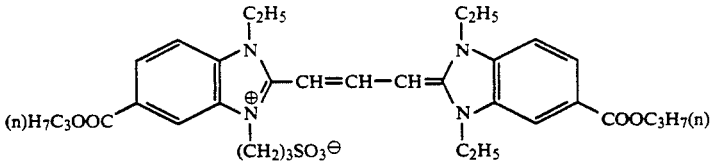
(III-3)
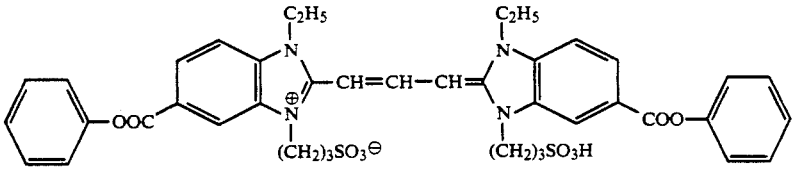
(III-4)
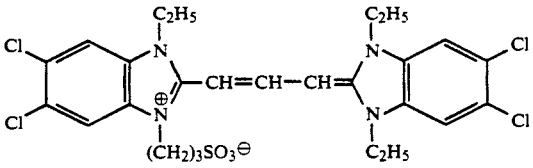

-continued
(III-5)
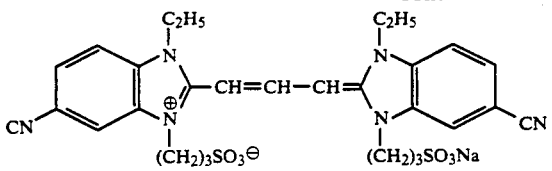
(III-6)
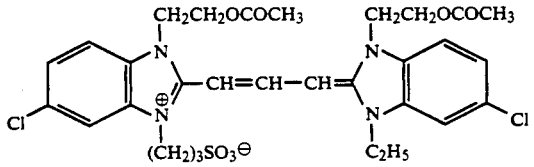
(III-7)
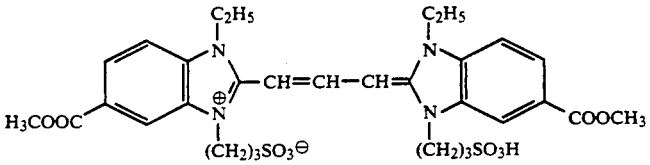
(III-8)
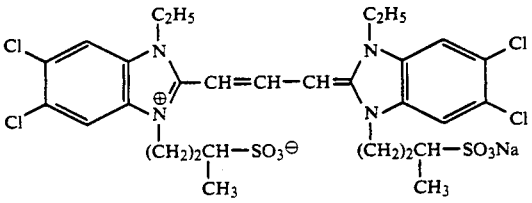
(III-9)
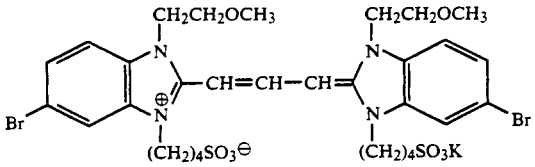
(III-10)
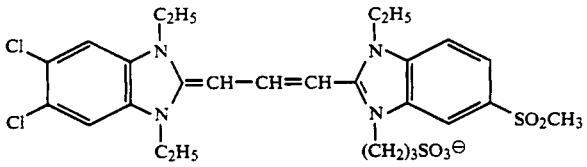
(III-11)
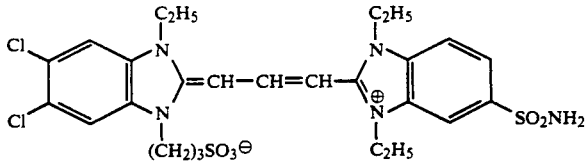
(III-12)
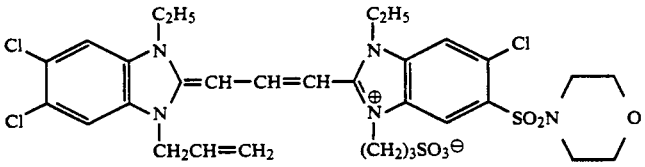
(III-13)
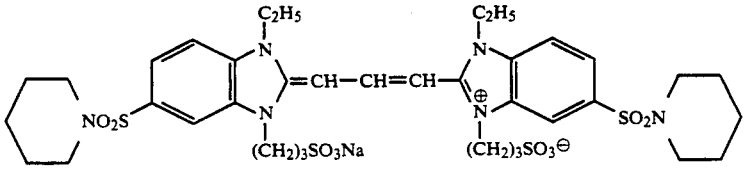

-continued
(III-14)
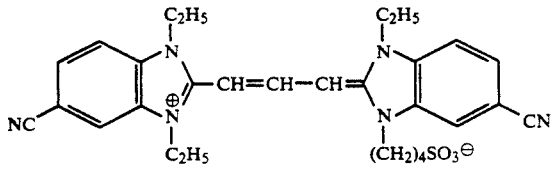
(III-15)
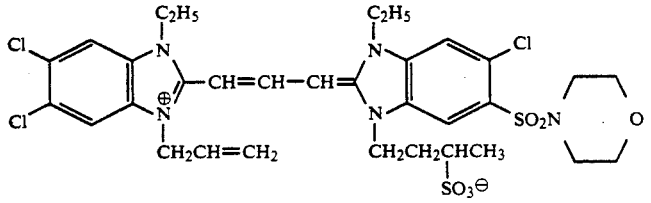
(III-16)
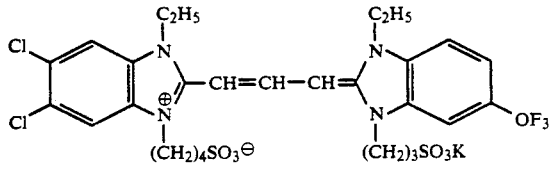
(III-17)
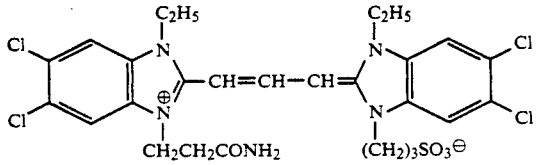
(III-18)
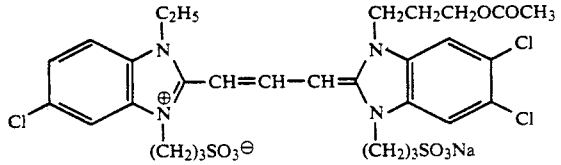
(III-19)
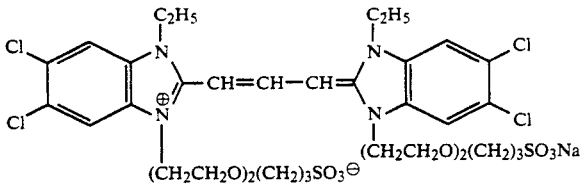
(III-20)
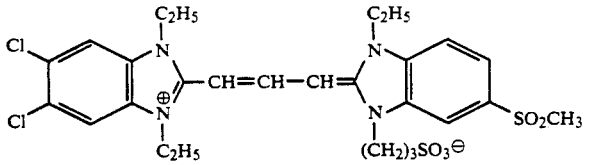
(III-21)
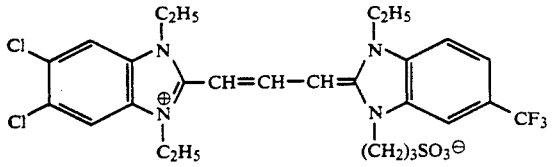
(III-22)
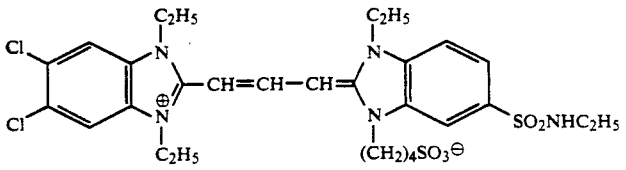

-continued

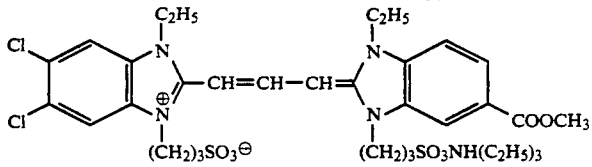
(III-23)

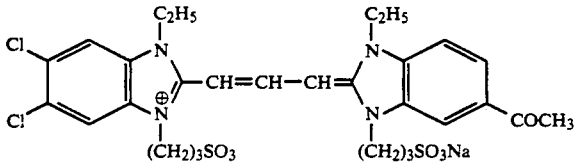
(III-24)

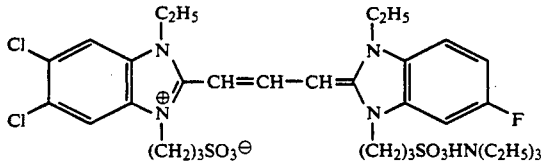
(III-25)

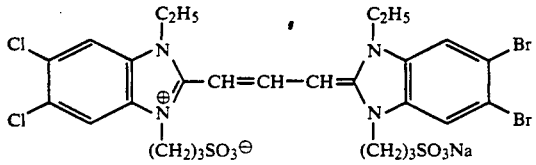
(III-26)

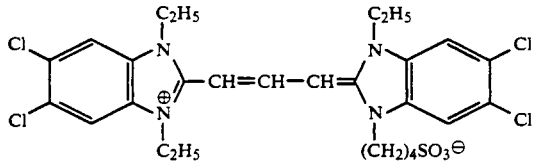
(III-27)

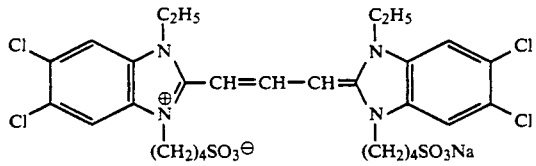
(III-28)

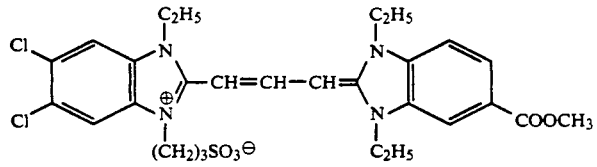
(III-29)

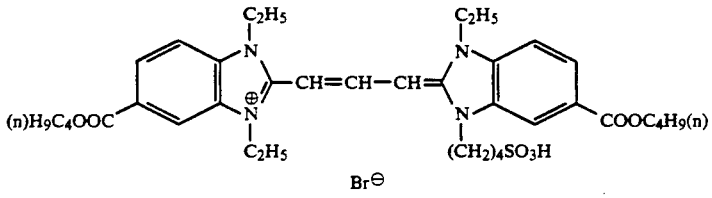
(III-30)

The emulsions that characterize the present invention may be composed of any silver halide such as silver chloride, silver bromide, silver chlorobromide, silver chloroiodobromide or silver iodobromide, with silver iodobromide being preferred. Silver iodobromide emulsions preferably have grains the interior of which is made of at least two portions having different halide compositions. Particularly preferred are core/shell emulsions having higher a AgI content in the core than in the shell. A preferred method of adding AgI is to add fine AgI grains during crystal growth, and it is particularly preferred to perform crystal growth after adding fine AgBrI grains. In core/shell emulsions, the AgI content of the core is preferably not more than 40 mol %, with the range of 10–40 mol % being particularly preferred.

In preparing the emulsions that characterize the present invention, as well as other emulsions that may also be used as required in producing photographic materials, non-gelatin materials that can adsorb on silver halide grains may be added and this is also true in the case of preparing seed emulsion. Heavy metal ions or compounds that are customarily used in the art as spectral sensitizers, antifoggants or stabilizers may be used as those adsorbing materials. Specific examples of such adsorbing materials are described in JP-A-62-7040.

Adding at least one of antifoggants and stabilizers as adsorbing materials during the preparation of seed emulsions is preferred since this is effective in reducing the fogging of emulsions and improving their keeping quality. Among antifoggants and stabilizers, heterocyclic mercapto compounds and/or azaindene compounds are particularly preferred. Specific examples of more preferred heterocyclic mercapto compounds and azaindene compounds that are suitable for use are described in detail in JP-A-63-41848.

The amounts in which those heterocyclic mercapto compounds and azaindene compounds are used are not limited to any particular values but they are preferably used in amounts of $1\times10^{-5}$ to $3\times10^{-2}$ moles per mole of silver halide, with the range of $5\times10^{-5}$ to $3\times10^{-3}$ moles per mole of silver being more preferred. Suitable amounts should be selected depending upon the conditions of preparing silver halide grains, their average grain size, and the types of those heterocyclic mercapto compounds and azaindene compounds.

Finished emulsions that have been conditioned to have predetermined conditions of grains may be subjected to desalting by known procedures after the formation of silver halide grains. Desalting may be performed using gelatin flocculants or other agents that are employed to desalt seed grains as described in JP-A-63-243936 and JP-A-Hei-1-185549. Alternatively, noodle washing which involves gellation of gelatin may be adopted. If desired, flocculation methods may be practiced using inorganic salts such as sodium sulfate that are composed of polyvalent anions, anionic surfactants or anionic polymers (e.g. polystyrenesulfonic acid).

The thus desalted silver halide grains are customarily redispersed in gelatin to prepare emulsions.

The emulsions that characterize the present invention may be chemically sensitized in the usual manner. Useful methods of chemical sensitization include: sulfur sensitization using activated gelatin or compounds that contain sulfur capable of reacting with silver ions; selenium sensitization using selenium compounds; reduction sensitization using reducing materials; and noble metal sensitization using gold and other noble metal compounds. These methods may be used either independently or in combination.

Chalcogenide sensitizers may be used as chemical sensitizers and among them, sulfur sensitizers and selenium sensitizers are particularly preferred. Exemplary sulfur sensitizers include thiosulfates, allyl thiocarbazide, thiourea, allyl isothiocyanate, cystine, p-toluenesulfonates and rhodanine. Other useful sulfur sensitizers are described in U.S. Pat. Nos. 1,574,944, 2,410,689, 2,278,947, 2,728,668, 3,501,313, 3,656,955, German Patent Application (OLS) No. 1,422,869, JP-A-56-24937, JP-A-55-45016, etc. The amounts in which sulfur sensitizers are added will vary considerably depending upon various conditions such as pH, temperature and the size of silver halide grains. As a guide, the range of $10^{-7}$ to $10^{-1}$ mole per mole of silver halide is preferred.

Exemplary selenium sensitizers include aliphatic isoselenocyanates (e.g. allyl isoselenocyanate), selenoureas, selenoketones, selenoamides, selenocarboxylates or esters thereof, selenophosphates, and selenides (e.g. diethyl selenide). Specific examples of these compounds are described in U.S. Pat. Nos. 1,574,944, 1,602,592, and 1,623,499.

Reduction sensitizers may be used in combination with sulfur or selenium sensitizers. Exemplary reducing agents include stannous chloride, thiourea dioxide, hydrazine and polyazine.

Compounds of noble metals other than gold may also be used and examples are palladium compounds.

The silver iodobromide grains in the emulsions that characterize the present invention preferably contain gold compounds. Gold compounds that are preferably used in the present invention may have an oxidation number of one or three and many kinds of gold compounds may be employed. Typical examples include chloroaurates (e.g. potassium chloroaurate), auric trichloride, potassium auric thiocyanate, potassium iodoaurate, tetracyanoauric azide, ammonium aurothiocyanate, pyridyl trichlorogold, gold sulfide and gold selenide.

Gold compounds may be used in such a way that they sensitize silver halide grains or they may be used in such a way that they do not substantially contribute to sensitization.

The amounts in which gold compounds are added will depend upon various conditions but as a guide they are used in amounts of $10^{-8}$ to $10^{-1}$ mole per mole of silver halide, with the range of $10^{-7}$ to $10^{-2}$ mole per mole of silver halide being preferred. Gold compounds may be added at any stage, i.e., during the formation of silver halide grains, during physical ripening, during chemical ripening, or after the end of chemical ripening.

Emulsions can be optically sensitized with spectral sensitizers to have sensitivity in a desired wavelength range. Spectral sensitizers may be used either independently or in combination. In addition to spectral sensitizers, emulsions may also contain dyes that themselves are devoid of spectral sensitizing action or supersensitizers which are compounds that are substantially incapable of absorbing visible light and that enhance the sensitizing action of spectral sensitizers.

When the emulsions that characterize the present invention are used to constitute silver halide photographic materials, the latter may be used as any light-sensitive materials including black-and-white photographic materials (e.g. X-ray films, litho-graphic light-sensitive materials and negative films for black-and-white photography) and color photographic materials (e.g. color negative films, color reversal films and color papers).

Those silver halide photographic materials can also be used as diffusion transfer light-sensitive materials (e.g. color diffusion transfer elements and silver salt diffusion transfer elements) and heat-processable light-sensitive materials (for both black-and-white and color photography).

In order to perform color reproduction by the subtractive process, the light-sensitive material of the present invention when used as a multi-color photographic material has such a structure that a blue-, green- and a red-sensitive silver halide emulsion layer containing a yellow, a magenta and a cyan photographic coupler, as well as optional non-light-sensitive layers are superposed in a desired number and order on a support. The number and order of emulsion layers and non-light-sensitive layers may be altered depending on the performance that is specifically needed and the object of use.

The photographic material of the present invention may contain any additives including an antifoggant, a hardener, a plasticizer, a latex, a surfactant, a color fog preventing agent, a matting agent, a lubricant, an antistat, etc.

To form image, the photographic material may be subjected to various procedures of black-and-white or color development. The color developing agent to be used in color development may be selected from among aminophenolic and p-phenylenediamino derivatives which are commonly employed in various color photographic processes. The color developing solution to be used in processing the photographic material may contain not only primary aromatic amino color developing agents but also compounds known to be used as components of developing solutions. The photographic material of the present invention is also processable with a developing system that does not contain benzyl alcohol which has a potential pollution hazard.

The color developing solution usually has a pH of at least 7, most typically in the range of ca. 10–13.

The temperature for color development is usually at least 15° C., typically in the range of 20°–50° C. For rapid development, temperatures of 30° C. and above are preferably used. The usual procedure requires 3–4 minutes for development but if emulsions are combined in such a way as to achieve rapid processing, the time of color development can usually be reduced to 20–60 seconds, or even to 30–50 seconds.

The color developed photographic material is usually subjected to bleaching and fixing, with bleaching being optionally performed simultaneously with fixing.

The fixed photographic material is usually washed with water. Stabilization may be performed either as a substitute for washing with water or in combination with the latter.

The following example is provided for the purpose of further illustrating the present invention but is in no way to be taken as limiting.

In the following example, the amounts of components or additives in silver halide photographic materials are expressed in grams per square meter unless otherwise noted. The amounts of silver halides and colloidal silver are calculated for silver.

EXAMPLE 1

Multi-layered color photographic material (sample 101) was prepared by forming the following layers in the order written on a triacetyl cellulose film base.

| Sample 101 (comparison): | |
|---|---|
| First layer: Anti-halo layer (HC-1) | |
| Black colloidal layer | 0.2 |
| UV Absorber (UV-1) | 0.23 |
| High-boiling point Solvent (Oil-1) | 0.18 |
| Gelatin | 1.4 |
| Second layer: First intermediate layer (IL-1) | |
| Gelatin | 1.3 |
| Third layer: Less red-sensitive emulsion layer (RL) | |
| Silver iodobromide emulsion (average grain size, 0.4 μm) | 1.0 |
| Spectral sensitizer (I-40) | $1.8 \times 10^{-5}$ mol/mol Ag |
| Spectral sensitizer (I-6) | $1.6 \times 10^{-4}$ mol/mol Ag |
| Cyan coupler (C-1) | 0.70 |
| Colored cyan coupler (CC-1) | 0.066 |
| DIR compound (D-1) | 0.03 |
| DIR compound (D-3) | 0.01 |
| High boiling point solvent (Oil-1) | 0.64 |
| Gelatin | 1.2 |
| Fourth layer: Moderate red-sensitive emulsion layer (RM) | |
| Silver iodobromide emulsion (average grain size, 0.7 μm) | 0.8 |
| Spectral sensitizer (I-40) | $2.1 \times 10^{-5}$ mol/mol Ag |
| Spectral sensitizer (I-6) | $1.9 \times 10^{-4}$ mol/mol Ag |
| Cyan coupler (C-1) | 0.28 |
| Colored cyan coupler (CC-1) | 0.027 |
| DIR compound (D-1) | 0.01 |
| High-boiling point solvent (Oil-1) | 0.26 |
| Gelatin | 0.6 |
| Fifth layer: Highly red-sensitive emulsion layer (RH) | |
| Silver iodobromide emulsion (average grain size, 0.8 μm) | 1.70 |
| Spectral sensitizer (I-40) | $1.9 \times 10^{-5}$ mol/mol Ag |
| Spectral sensitizer (I-6) | $1.7 \times 10^{-4}$ mol/mol Ag |
| Cyan coupler (C-1) | 0.05 |
| Cyan coupler (C-2) | 0.10 |
| Colored cyan coupler (CC-1) | 0.02 |
| DIR compound (D-1) | 0.025 |
| High-boiling point solvent (Oil-1) | 0.17 |
| Gelatin | 1.2 |
| Sixth layer: Second intermediate layer (IL-2) | |
| Gelatin | 0.8 |
| Seventh layer: Less green-sensitive emulsion layer (GL) | |
| Silver iodobromide emulsion (average grain size, 0.4 μm) | 1.1 |
| Spectral sensitizer (SD-1) | $6.2 \times 10^{-4}$ mol/mol Ag |
| Magenta coupler (M-1) | 0.54 |
| Magenta coupler (M-2) | 0.19 |
| Colored magenta coupler (CM-1) | 0.06 |
| DIR compound (D-2) | 0.017 |
| DIR compound (D-3) | 0.01 |
| High-boiling point solvent (Oil-2) | 0.81 |
| Gelatin | 1.8 |

-continued

| Sample 101 (comparison): | |
|---|---|
| Eighth layer: Moderate green-sensitive emulsion layer (GM) | |
| Silver iodobromide emulsion (average grain size, 0.7 μm) | 0.7 |
| Spectral sensitizer (SD-2) | $1.9 \times 10^{-4}$ mol/mol Ag |
| Spectral sensitizer (SD-3) | $1.2 \times 10^{-4}$ mol/mol Ag |
| Spectral sensitizer (SD-4) | $1.5 \times 10^{-5}$ mol/mol Ag |
| Magenta coupler (M-1) | 0.07 |
| Magenta coupler (M-2) | 0.03 |
| Colored magenta coupler (CM-1) | 0.04 |
| DIR compound (D-2) | 0.018 |
| High-boiling point solvent (Oil-2) | 0.30 |
| Gelatin | 0.8 |
| Ninth layer: Highly green-sensitive emulsion layer (GH) | |
| Silver iodobromide emulsion (average grain size, 1.0 μm) | 1.7 |
| Spectral sensitizer (SD-2) | $1.2 \times 10^{-4}$ mol/mol Ag |
| Spectral sensitizer (SD-3) | $1.0 \times 10^{-4}$ mol/mol Ag |
| Spectral sensitizer (SD-4) | $3.4 \times 10^{-6}$ mol/mol Ag |
| Magenta coupler (M-1) | 0.09 |
| Magenta coupler (M-3) | 0.04 |
| Colored magenta coupler (CM-1) | 0.04 |
| High-boiling point solvent (Oil-2) | 0.31 |
| Gelatin | 1.2 |
| Tenth layer: Yellow filter layer (YC) | |
| Yellow colloidal silver | 0.05 |
| Anti-color stain agent (SC-1) | 0.1 |
| High-boiling point solvent (Oil-2) | 0.13 |
| Gelatin | 0.7 |
| Formaldehyde scavenger (HS-1) | 0.09 |
| Formaldehyde scavenger (HS-2) | 0.07 |
| Eleventh layer: Less blue-sensitive emulsion layer (BL) | |
| Silver iodobromide emulsion (average grain size, 0.4 μm) | 0.5 |
| Silver iodobromide emulsion (average grain size, 0.7 μm) | 0.5 |
| Spectral sensitizer (SD-5) | $5.2 \times 10^{-4}$ mol/mol Ag |
| Spectral sensitizer (SD-6) | $1.9 \times 10^{-5}$ mol/mol Ag |
| Yellow coupler (Y-1) | 0.65 |
| Yellow coupler (Y-2) | 0.24 |
| DIR compound (D-1) | 0.03 |
| High-boiling point solvent (Oil-2) | 0.18 |
| Gelatin | 1.3 |
| Formaldehyde scavenger (HS-1) | 0.08 |
| Twelfth layer: Highly blue-sensitive emulsion layer (BH) | |
| Silver iodobromide emulsion (average grain size, 1.0 μm) | 1.0 |
| Spectral sensitizer (SD-5) | $1.8 \times 10^{-4}$ mol/mol Ag |
| Spectral sensitizer (SD-6) | $7.9 \times 10^{-5}$ mol/mol Ag |
| Yellow coupler (Y-1) | 0.15 |
| Yellow coupler (Y-2) | 0.05 |
| High-boiling point solvent (Oil-2) | 0.074 |
| Gelatin | 1.30 |
| Formaldehyde scavenger (HS-1) | 0.05 |
| Formaldehyde scavenger (HS-2) | 0.12 |
| Thirteenth layer: First protective layer (Pro-1) | |
| Fine-grain silver iodobromide emulsion (average grain size, 0.08 μm; 1 mol % AgI) | 0.4 |
| Ultraviolet absorber (UV-1) | 0.07 |
| Ultraviolet absorber (UV-2) | 0.10 |
| High-boiling point solvent (Oil-1) | 0.07 |
| High-boiling point solvent (Oil-3) | 0.07 |
| Formaldehyde scavenger (HS-1) | 0.13 |
| Formaldehyde scavenger (HS-2) | 0.37 |
| Gelatin | 1.3 |
| Fourteenth layer: Second protective layer (Pro-2) | |
| Alkali-soluble matting agent (average particle size, 2 μm) | 0.13 |
| Polymethyl methacrylate (average particle size, 3 μm) | 0.02 |
| Slip agent (WAX-1) | 0.04 |
| Gelatin | 0.6 |

C-1

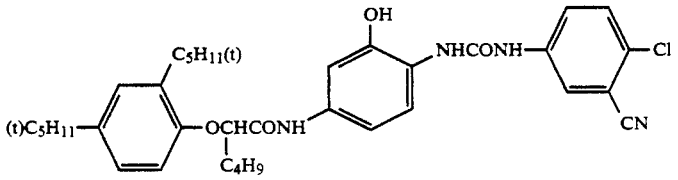

C-2

-continued
Sample 101 (comparison):
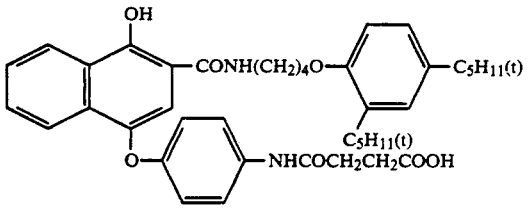
M-1
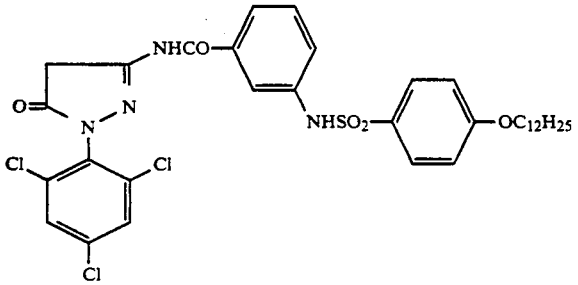
M-2
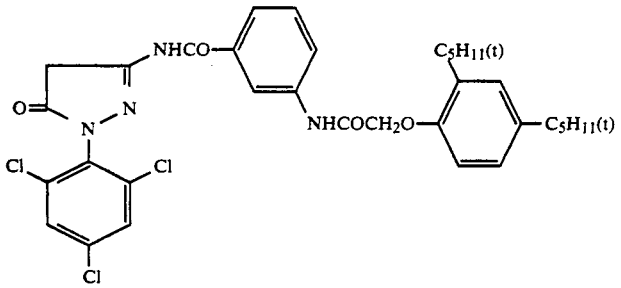
M-3
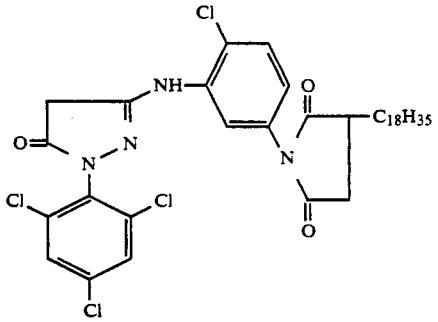
Y-1
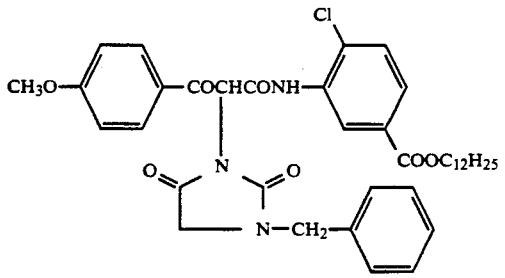
Y-2

-continued
Sample 101 (comparison):
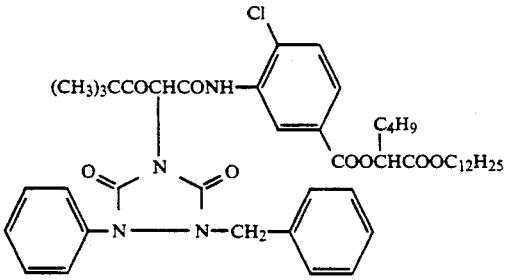
CC-1
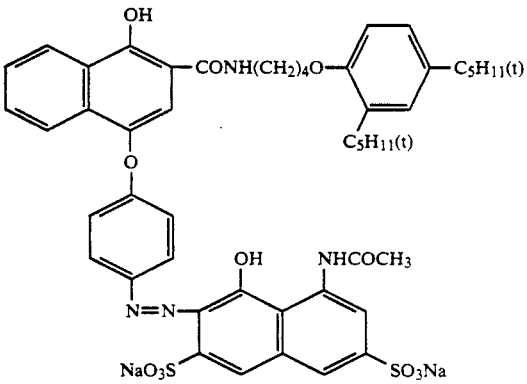
CM-1
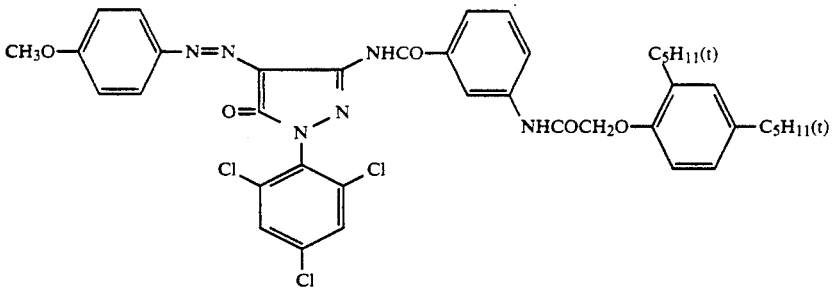
D-1
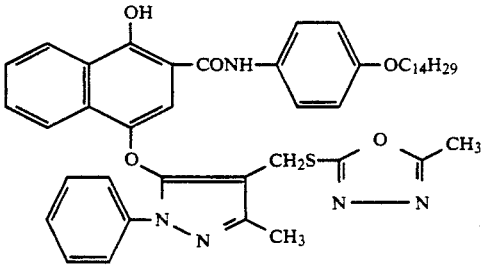
D-2

-continued
Sample 101 (comparison):
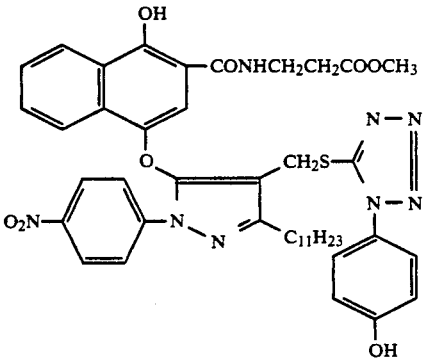
D-3
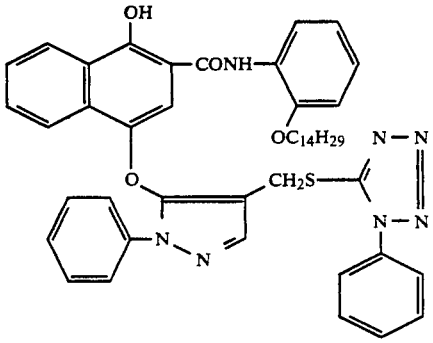
Oil-1
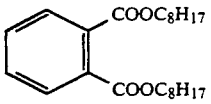
Oil-2
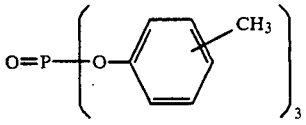
Oil-3
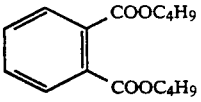
SC-1
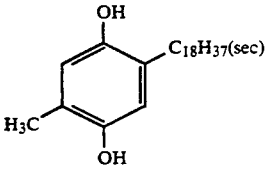
UV-1
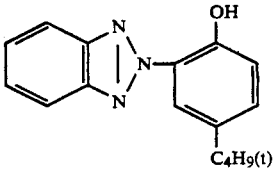
UV-2

-continued
Sample 101 (comparison):
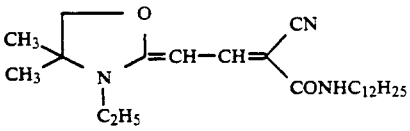
WAX-1
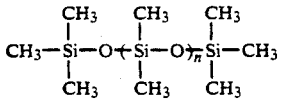
Weight average molecular weight (Mw) = 3,000
Su-1
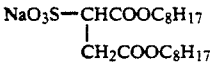
Su-2
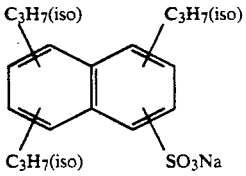
HS-1
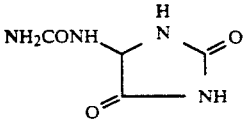
HS-2
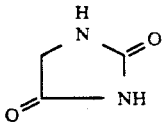
(SD-1)
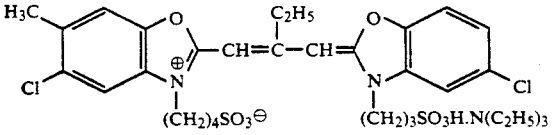
(SD-2)
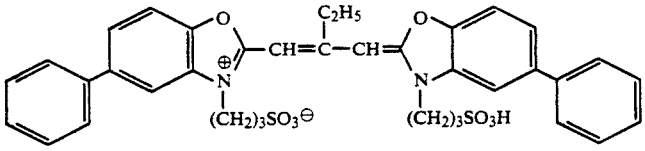
(SD-3)
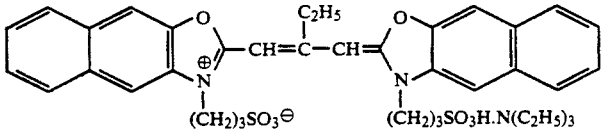
(SD-4)
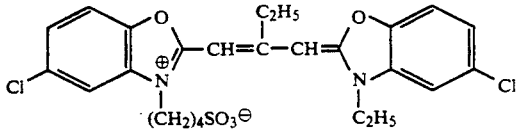

-continued

Sample 101 (comparison):

(SD-5)

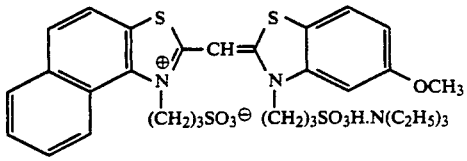

(SD-6)

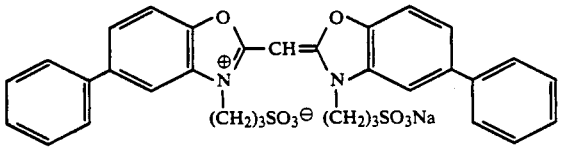

H-1

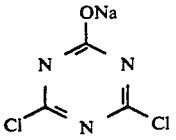

H-2
$(CH_2{=}CHSO_2CH_2)_2O$

ST-1

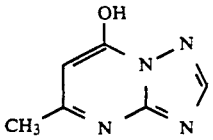

AF-1

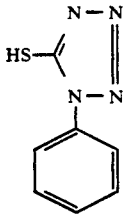

AF-2

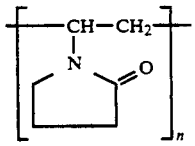

n: degree of polymerization

Besides the compounds mentioned above, a coating aid (Su-1), a dispersion aid (Su-2), a viscosity modifier, hardeners (H-1) and (H-2), a stabilizer (ST-1), an antifoggant (AF-1), and two species of AF-2 ($\overline{Mw}$: 10,000 and 1,100,000) were also added to each layer.

The emulsions used in sample 101 were core/shell type AgBrI emulsions having a higher AgI content (35 mol %) in the core than in the shell. The average grain size of these emulsions was expressed in terms of the size of a cube. Those emulsions were subjected to optimum gold-plus-sulfur sensitization.

Additional samples 102–107 were prepared by repeating the procedure for the preparation of sample 101 except that the spectral sensitizers in the third, fourth and fifth layers were changed to those shown in Table 1. The spectral sensitizers in samples 102–107 were added in such a way that the total amount of the spectral sensitizers in each layer was equimolar to the case of sample 101. The molar proportions of spectral sensitizers incorporated in each layer are parenthesized in Table 1 after the specific names of illustrative dyes. Table 1 shows only the molar proportions of spectral sensitizers added to the fourth layer but it should be noted that in each of samples 101–107, the same dyes were added in the same molar proportions in the third, fourth and fifth layers. The emulsions incorporated in each sample were subjected to optimum chemical sensitization in the usual manner using gold and sulfur sensitizers.

In order to determine the spectral responses of samples 101–107, they were processed by the scheme described below and spectral exposure was thereafter performed to measure respective parameters at an optical density of 1.0 for determination of spectral responses. The results are shown in Table 1. The photographic processing was performed continuously until a stabilizing replenisher was permitted to flow in a volume three times the capacity of the stabilizing tanks.

| Scheme | Time | Temperature | Amount of replenisher |
|---|---|---|---|
| Color development | 3 min and 15 sec | 38° C. | 540 ml |
| Bleaching | 45 sec | 38° C. | 155 ml |
| Fixing | 1 min and 45 sec | 38° C. | 500 ml |
| Stabilization | 90 sec | 38° C. | 775 ml |
| Drying | 1 min | 40–70° C. | — |

(The amount of replenisher is based on one square meter of the photographic material.)

Stabilization was performed by a three-tank countercurrent system with the replenisher being supplied into the last tank and overflowing into the preceding tanks.

An overflow from the stabilizing tanks was partly (275 ml/m$^2$) directed into the preceding fixing tank.

The processing solutions used in the color developing, bleaching, fixing and stabilizing steps had the following compositions.

| | |
|---|---|
| Color developing solution | |
| Potassium carbonate | 30 g |
| Sodium hydrogencarbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxyethyl)aniline sulfate | 4.6 g |
| Diethylenetriaminepentaacetic acid | 3.0 g |
| Potassium hydroxide | 1.3 g |
| Water | to make 1,000 ml |
| pH | adjusted to 10.01 with potassium hydroxide or 20% sulfuric acid. |
| Color development replenisher | |
| Potassium carbonate | 40 g |
| Sodium hydrogencarbonate | 3 g |
| Potassium sulfite | 7 g |
| Sodium bromide | 0.5 g |
| Hydroxylamine sulfate | 3.2 g |
| 4-Amino-3-methyl-N-ethyl-N-(β-hydroxyethyl)aniline sulfate | 6.0 g |

-continued

| | |
|---|---|
| Diethylenetriaminepentaacetic acid | 3.0 g |
| Potassium hydroxide | 2 g |
| Water | to make 1,000 ml |
| pH | adjusted to 10.12 with potassium hydroxide or 20% sulfuric acid. |
| Bleaching solution | |
| 1,3-Diaminopropanetetraacetic acid iron (III) ammonium salt | 0.35 mol |
| Ethylenediaminetetraacetic acid disodium salt | 2 g |
| Ammonium bromide | 150 g |
| Glacial acetic acid | 40 ml |
| Ammonium nitrate | 40 g |
| Water | to make 1,000 ml |
| pH | adjusted to 4.5 with aqueous ammonia or glacial acetic acid. |
| Bleaching replenisher | |
| 1,3-Diaminopropanetetraacetic acid iron (III) ammonium salt | 0.40 mol |
| Ethylenediaminetetraacetic acid disodium salt | 2 g |
| Ammonium bromide | 170 g |
| Ammonium nitrate | 50 g |
| Glacial acetic acid | 61 ml |
| Water | to make 1,000 ml |
| pH | adjusted to 3.5 with aqueous ammonia or glacial acetic acid (as appropriate to maintain the pH of the bleaching tank solution). |
| Fixing solution (of the same composition as fixing replenisher) | |
| Ammonium thiosulfate | 100 g |
| Ammonium thiocyanate | 150 g |
| Anhydrous sodium bisulfite | 20 g |
| Sodium metabisulfite | 4.0 g |
| Ethylenediaminetetraacetic acid disodium salt | 1.0 g |
| Water | to make 700 ml |
| pH | adjusted to 6.5 with glacial acetic acid and aqueous ammonia. |
| Stabilizing solution (of the same composition as stabilizing replenisher) | |
| 1,2-Benzoisothiazolin-3-one | 0.1 g |
| 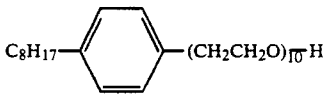 (50% sol.) | 2.0 ml |
| Hexamethylenetetramine | 0.2 g |
| Hexahydro-1,3,5-tris-(2-hydroxyethyl)-5-triamine | 0.3 g |
| Water | to make 1,000 ml |
| pH | adjusted to 7.0 with potassium hydroxide and 50% sulfuric acid. |

TABLE 1

| Sample No. | Layer | Spectral sensitizers (their molar proportions in parentheses) | | $\lambda_R^{max}$ (nm) | $\frac{S_R(\lambda_R^{610})}{S_R(\lambda_R^{max})}$ | $\lambda_R^{50}$ (nm) | Visual evaluation of print quality under fluorescent lamp 1) | Remarks |
|---|---|---|---|---|---|---|---|---|
| 101 | 4th | I-40 | (1) | 655 nm | 65% | 665 nm | 1 | Comparison |
| | | I-6 | (9) | | | | | |
| 102 | 4th | I-40 | (9) | 630 nm | 80% | 651 nm | 2 | |
| | | I-6 | (9) | | | | | |
| | | II-29 | (5) | | | | | |
| 103 | 4th | I-40 | (1) | 628 nm | 75% | 650 nm | 2 | |
| | | I-6 | (9) | | | | | |
| | | III-5 | (1) | | | | | |
| 104 | 4th | I-40 | (1) | 630 nm | 81% | 651 nm | 2 | |
| | | I-6 | (9) | | | | | |
| | | II-29 | (5) | | | | | |
| | | III-5 | (0.5) | | | | | |
| 105 | 4th | I-40 | (1) | 627 nm | 88% | 653 nm | 4 | Invention |
| | | I-6 | (9) | | | | | |
| | | II-29 | (5) | | | | | |
| | | III-5 | (5) | | | | | |
| 106 | 4th | I-40 | (1) | 625 nm | 95% | 653 nm | 5 | |

TABLE 1-continued

| Sample No. | Layer | Spectral sensitizers (their molar proportions in parentheses) | $\lambda_R^{max}$ (nm) | $\frac{S_R(\lambda_R^{610})}{S_R(\lambda_R^{max})}$ | $\lambda_R^{50}$ (nm) | Visual evaluation of print quality under fluorescent lamp 1) | Remarks |
|---|---|---|---|---|---|---|---|
| | | I-6 (9)<br>II-29 (5)<br>III-5 (10) | | | | | |
| 107 | 4th | I-40 (1)<br>I-6 (9)<br>III-5 (5) | 630 nm | 88% | 650 nm | 4 | |

1) Pictures of human figure were taken under a fluorescent lamp emitting at three wavelengths and the resulting prints were evaluated visually, with rating "1" assigned to a print that had intense green shades with dull appearance, and "5" assigned to a print that reproduced a clear flesh color with less green shades but with lively appearance. The large the number, the more faithful the color reproduction under the fluorescent lamp.

The results of spectral response measurements shown in Table 1 reveal that samples 105–107 were within the scope of the present invention. The spectral responses of the blue-sensitive and green-sensitive layers in these samples 105–107 satisfied the requirements of the present invention and they had sensitivities higher than ISO 320. It was also found that only the samples of the present invention had high rating in the visual evaluation of prints under a fluorescent lamp, thereby achieving one of the objects of the present invention, i.e., faithful color reproduction under a fluorescent lamp. Similar results were obtained in photographing under fluorescent lamps other than the one emitting at three wavelengths, but best results were attained with a lamp emitting at three wavelengths. This clearly attests to the fact that increasing the sensitivity to the spectrum line at 610 nm is the most important for quality photographing under a fluorescent lamp emitting at three wavelengths. Hence, the color photographic material of the present invention is effective in improving the color reproduction under fluorescent lamp.

What is claimed is:

1. In a color photographic material having on a support at least one blue-sensitive silver halide emulsion layer containing a yellow forming color coupler, at least one green-sensitive silver halide emulsion layer containing a magenta forming color coupler, and at least one red-sensitive silver halide emulsion layer containing a cyano forming color coupler, the improvement wherein the spectral response of said blue-sensitive silver halide emulsion layer, $S_B(\lambda)$, satisfies the following conditions:

(A) 410 nm $\leqq \lambda_B^{max} \leqq$ 480 nm where $\lambda_B^{max}$ is the wavelength at which $S_B(\lambda)$ is maximum; and (B) 470 nm $\leqq \lambda_B^{80} \leqq$ 490 nm where $\lambda_B^{80}$ is the wavelength at which $S_B(\lambda)$ is 80% of $S_B(\lambda_B^{max})$;

the spectral response of said green-sensitive silver halide emulsion layer, $S_G(\lambda)$, satisfies the following conditions;

(A) 530 nm $\leqq \lambda_G^{max} \leqq$ 590 nm where $\lambda_G^{max}$ is the wavelength at which $S_G(\lambda)$ is maximum; and (B) 520 nm $\leqq \lambda_G^{80} \leqq$ 550 nm and 550 nm $\leqq \lambda_G^{80} \leqq$ 600 nm where $\lambda_G^{80}$ is the wavelength at which $S_G(\lambda)$ is 80% of $S_G(\lambda_G^{max})$;

the spectral response of said red-sensitive silver halide emulsion layer, $S_R(\lambda)$, satisfies the following conditions:

(A) 600 nm $\leqq \lambda_R^{max} \leqq$ 640 nm where $\lambda_R^{max}$ is the wavelength at which $S_R(\lambda)$ is maximum; and (B) 580 nm $\leqq \lambda_R^{50} \leqq$ 600 nm and 645 nm $\leqq \lambda_R^{50} \leqq$ 659 nm where $\lambda_R^{50}$ is the wavelength at which $S_R(\lambda)$ is 50% of $S_R(\lambda_R^{max})$, with $S_R(\lambda_R^{610})$, or the sensitivity at 610 nm, being at least 85% of $S_R(\lambda_R^{max})$, or the sensitivity at the wavelength of maximum sensitivity, wherein the red-sensitive silver halide emulsion layer contains the combination of at least one spectral sensitizer represented by the following general formula (I), at least one spectral sensitizer represented by the following general formula (II) and at least one spectral sensitizer represented by the following general formula (III):

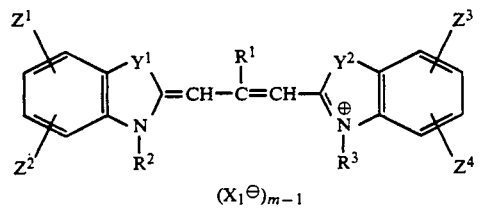

(I)

where $R^1$ is a hydrogen atom, an alkyl group or an aryl group; $R^2$ and $R^3$ are each an alkyl group; $Y^1$ and $Y^2$ are each a sulfur atom or a selenium atom; $Z^1$, $Z^2$, $Z^3$ and $Z^4$ are each a hydrogen atom, a halogen atom, a hydroxyl group, an alkoxy group, an amino group, an acyl group, an acylamino group, an acyloxy group, an aryloxy group, an alkoxycarbonyl group, an aryloxycarbonylgroup, an alkoxycarbonylamino group, a sulfonyl group, a carbamoyl group, an aryl group, an alkyl group or a cyano group; $Z^1$ and $Z^2$ and/or $Z^3$ and $Z^4$ may combine together to form a ring; $X_1^{\ominus}$ is an anion; m is an integer of 1 or 2, provided that m is 1 when the spectral sensitizer of (I) forms an intramolecular salt;

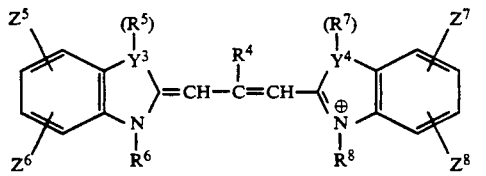

(II)

where $R^1$ is a hydrogen atom, an alkyl group or an aryl group; $R^5$, $R^6$, $R^7$ and $R^8$ are each an alkyl group; $Y^3$ and $Y^4$ are each a nitrogen atom, an oxygen atom, a sulfur atom or a selenium atom, provided that when $Y^3$ is a sulfur atom, an oxygen atom or a selenium atom, $R^5$ is absent and also provided that $Y^3$ and $Y^4$ are not a nitrogen atom at the same time; $Z^5$, $Z^6$, $Z^7$ and $Z^8$ are each a hydrogen atom, a halogen atom, a hydroxyl atom, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, provided that $Z^5$ and $Z^6$ and/or $Z^7$ and $Z^8$ may combine together to form a ring; $X_2^{\ominus}$ is an anion; and n is an integer of 1 or 2, provided that n is 1 when the spectral sensitizer of (II) forms an intramolecular salt;

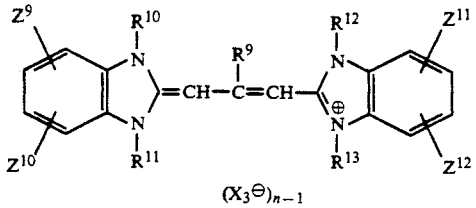

(III)

where $R^9$ is a hydrogen atom, an alkyl group or an aryl group; $R^{10}$, $R^{11}$, $R^{12}$ and $R^{13}$ are each an alkyl group; $Z^9$, $Z^{10}$, $Z^{11}$ and $Z^{12}$ are each a hydrogen atom, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a carbamoyl group, an aryl group, an alkyl group, a cyano group or a sulfonyl group, provided that $Z^9$ and $Z^{10}$ and/or $Z^{11}$ may combine to form a ring; $X_3^{\ominus}$ is an anion; and n is an integer of 1 or 2 provided that n is 1 when the spectral sensitizer of (III) forms an intramolecular salt.

2. A color photographic material according to claim 1 wherein $S_R(\lambda_R^{610})$ is at least 90% of $S_R(\lambda_R^{max})$.

3. A color photographic material according to claim 1 which is produced by adding a heterocyclic mercapto compound and/or an azaindene compound is added during the preparation of the emulsions.

4. A color photographic material according to claim 1 which is produced by chemically sensitizing the emulsions by sulfur sensitization, selenium sensitization, reduction sensitization or noble metal sensitization, which methods are applied either independently or in combination.

5. A color photographic material according to claim 1 wherein the silver iodobromide grains in the emulsions contain a gold compound.

* * * * *